United States Patent [19]

Rosenthal et al.

[11] Patent Number: 4,590,737

[45] Date of Patent: May 27, 1986

[54] APPARATUS AND METHOD FOR ROLL WRAPPING ARTICLES

[75] Inventors: Henry Rosenthal; Howard E. Kronhaus, both of Boca Raton, Fla.

[73] Assignee: HaDiHo, Pompano Beach, Fla.

[21] Appl. No.: 645,712

[22] Filed: Aug. 30, 1984

[51] Int. Cl.[4] ..... B65B 11/04

[52] U.S. Cl. ..... 53/211; 53/587; 53/502; 177/145

[58] Field of Search ..... 53/204, 211, 216, 225, 53/502, 587, 588; 414/21; 177/145, 262

[56] References Cited

U.S. PATENT DOCUMENTS

| | | | |
|---|---|---|---|
| 4,085,566 | 3/1978 | Crowe et al. | 53/529 |
| 4,281,500 | 8/1981 | Mueller et al. | 53/211 |
| 4,362,001 | 12/1982 | Cockerham | 53/211 X |
| 4,458,470 | 7/1984 | Fine | 53/502 |
| 4,480,422 | 11/1984 | Meives | 53/207 X |
| 4,498,276 | 2/1985 | Reed | 53/204 X |

FOREIGN PATENT DOCUMENTS 0079321 5/1983 European Pat. Off. ..... 211/

OTHER PUBLICATIONS

Marks' Std. Handbook for MEs, 1978, pp. 5-58, 5-59 and 16-4.

*Primary Examiner*—John Sipos
*Assistant Examiner*—Steven P. Weihrouch
*Attorney, Agent, or Firm*—Pennie & Edmonds

[57] ABSTRACT

An apparatus is disclosed for roll wrapping articles with stretchable netting material and simultaneously weighing the articles. The apparatus includes horizontal article support rollers supported on a rotatable table, the support rollers being quickly adjustably movable equidistantly toward and away from each other to accomodate articles of numerous sizes and weights while maintaining the center of gravity of the article generally centrally positioned with respect to the support rollers and the rotatable table.

24 Claims, 5 Drawing Figures

APPARATUS AND METHOD FOR ROLL WRAPPING ARTICLES

FIELD OF THE INVENTION

The present invention relates to an improved apparatus for roll wrapping articles wherein the article is supported on horizontally rotatable support rollers on a rotatable platform such that the article is rotated about two mutually perpendicular axes while being wrapped.

BACKGROUND OF THE INVENTION

Roll wrapping devices of the prior art generally rotate the article to be wrapped, while a stretchable web or netting material such as thermoplastic film or cloth, or a relatively non-stretchable web material such as paper, is dispensed for wrapping theraround. In the apparatus of the type contemplated by the invention, two support rollers are generally positioned on a horizontal ("lazy susan type") rotatable table while the article is simultaneously rotated about its own horizontal axis. The support rollers are often spaced to accomodate articles of several sizes.

Such devices in the past, have been provided with means for increasing the distance between the support rollers by shifting one of the rollers toward or away from the outer support roller, the position of which is fixed. Thus, when the movable roller is shifted outwardly, the center of support shifts, causing the danger of shifting the entire apparatus when the article is extremely heavy.

In the prior art devices, the article is wrapped while it is rotated in one direction about its own horizontal axis and simultaneously rotated about a vertical axis by virtue of the rotating platform upon which the support rollers are positioned. Thus, wrapping the article with these devices is not a very precise operation and control of overlap and wrapping direction is not as effective as would otherwise be desirable. Moreover, once the article is wrapped in this manner, it must be removed to a weighing station for weighing. Thus, in addition to providing a wrapping which leaves some to be desired, the wrapping and weighing operation is a time consuming procedure which leaves room for improvement. I have invented an apparatus for roll wrapping articles which avoids the disadvantages of the prior art.

DISCLOSURE OF THE INVENTION

The term "web type wrapping material" as used herein includes, but is not limited to, relatively stretchable materials such as thermoplastic webbing, film, or netting and cloth fabric or netting, as well as relatively non-stretchable materials such as paper or cardboard. Other web-type mateerials contemplated by the invention are known to those skilled in the art.

The present invention relates to an apparatus for wrapping articles which comprises a frame, platform mounted on the frame for rotation about a substantially vertical axis, at least two elongated support rollers mounted on the rotatable platform for rotation about a substantially horizontal axis extending therethrough, a supply of web type wrapping material mounted on the frame, the wrapping material supply being movably positioned and adapted for dispensing and wrapping about an article supported on the horizontally rotatable rollers as the platform rotates about a vertical axis, means for selectively moving the supply of wrapping material in an upward and downward direction so as to selectively vary the vertical height at which the wrapping material is dispensed from the wrapping material supply, means for rotatably driving at least one of the substantially horizontal rollers in either of two directions of rotation such that an article to be wrapped rotates about a substantially horizontal axis when the driven support roller is rotated in a first direction and the rotating article engages the other supporting horizontal roller and rotates the other support roller in the same direction as the first driven roller, and means for selectively varying the horizontal dimension between the horizontal rotatable support rollers by equal and opposite movements respectively toward and away from each other to maintain the center of gravity of the article in substantially the same location with respect to the frame and thereby providing capability to support articles of numerous sizes and weights.

In the apparatus according to the invention the rotating platform is rotationally supported by the frame and means is positioned between the rotatable platform and the frame for supplying a signal which corresponds to the weight of an article positioned on the frame so as to thereby provide the weight of the article. The apparatus also includes means for providing the article weight indication in the form of a plurality of load cells connected to an electrical circuit. The plurality of load cells are preferably equally distributed with respect to the rotatable platform, and the electrical circuitry comprises means for indicating the weight of the rotatable platform and the article positioned thereon.

The apparatus also includes means for initially subtracting the weight of the platform from the indicated weight thereby indicating the weight of the article, and at least one of the horizontally rotatable rollers is preferably driven by a motor.

The roller drive motor is connected for driving rotation of the first mentioned support roller by a system of sprockets and at least one drive chain, and the direction of this drive motor is selectively reversible so as to facilitate reversing the direction of the first mentioned driven horizontal support roller and thereby the direction of the article is simultaneously reversed as the platform is rotated about a substantially vertical direction.

Alternatively, any power transmission system may be used. For example, the sprockets and drive chain may be replaced by a system of pulleys and belts, including V-belts or flat belts. Another example of a power transmission system is a system of gears.

The apparatus also includes means for varying the dimension between the horizontally rotatable support rollers in the form of an elngated threaded rod threadedly connected to opposite support roller support members, each roller support member respectively supporting one of the horizontally rotatable rollers for rotation about a horizontal axis extending therethrough. The threaded rod is comprised of two sections separated by a manually operable adjustment means. The two sections of the threaded rod are equally and oppositely threaded and are connected to correspondingly mating threaded members respectively connected to the respective support members of the horizontally rotatable support rollers.

The manual adjustment means comprises a hand operable wheel connected to the rod at its center, such that rotation of the wheel rotates the threaded rod thereby causing the roller support members and the rollers to be moved toward or away from each other in equal and opposite directions in dependence upon the direction of rotation selected for the adjustment wheel for varying the dimension between the horizontal support rollers in dependence upon the dimensions of the article to be wrapped. The rotation of the horizontal platform about a vertical axis combined with the rotation of the horizontal support rollers and the article about its horizontal axis and the selective upward and downward movement of the supply of web-type wrapping material as the wrapping material is dispensed and wrapped about the rotating article combines with the selective reversing rotation of the driven horizontal roller to provide a criss-cross wrapping pattern of the netting material about the article.

Alternatively, in place of a hand operable control wheel, a motorized adjustment system may be incorporated.

Preferably the web-type wrapping material is in the form of a roll of stetchable wrapping film such as nylon, polypropylene, PVC, polybutylene, polyethylene, or copolymers or blends thereof, cloth, paper, or the like, rotatably mounted to dispense material as required. Alternatively, means may be provided to support and dispense the stretchable web-type wrapping materials in a pre-stretched condition.

A method is also disclosed for roll wrapping articles or the like which comprises, supporting the article on at least two support rollers, at least one of the support rollers being rotatably driven, the other support roller being supported for rotation about a horizontal axis, supporting the support rollers on a rotatable platform selectively driven by motor and drive means connected thereto, providing a supply of web-type wrapping material positioned for dispensing and wrapping about the article, rotating the platform and the article support rollers and thereby the article about a substantially vertical axis, selectively rotating the driven support roller so as to rotate the article and the other support roller therewith, and selectively reversing the rotational direction of the driven article support roller as the article rotates about the substantially vertical axis, and as the wrapping material is wrapped therearound so as to provide a criss-cross wrapped pattern of wrapping material about the article.

Preferably, the method of weighing the article is practiced during or after wrapping by utilizing weighing means comprising load cells and circuitry located on, and connected to, the apparatus.

DETAILED DESCRIPTION OF THE DRAWINGS

Preferred embodiments of the invention are described hereinbelow with reference to the drawings wherein.

DESCRIPTION OF THE PREFERRED EMBODIMENTS

Figure 1:
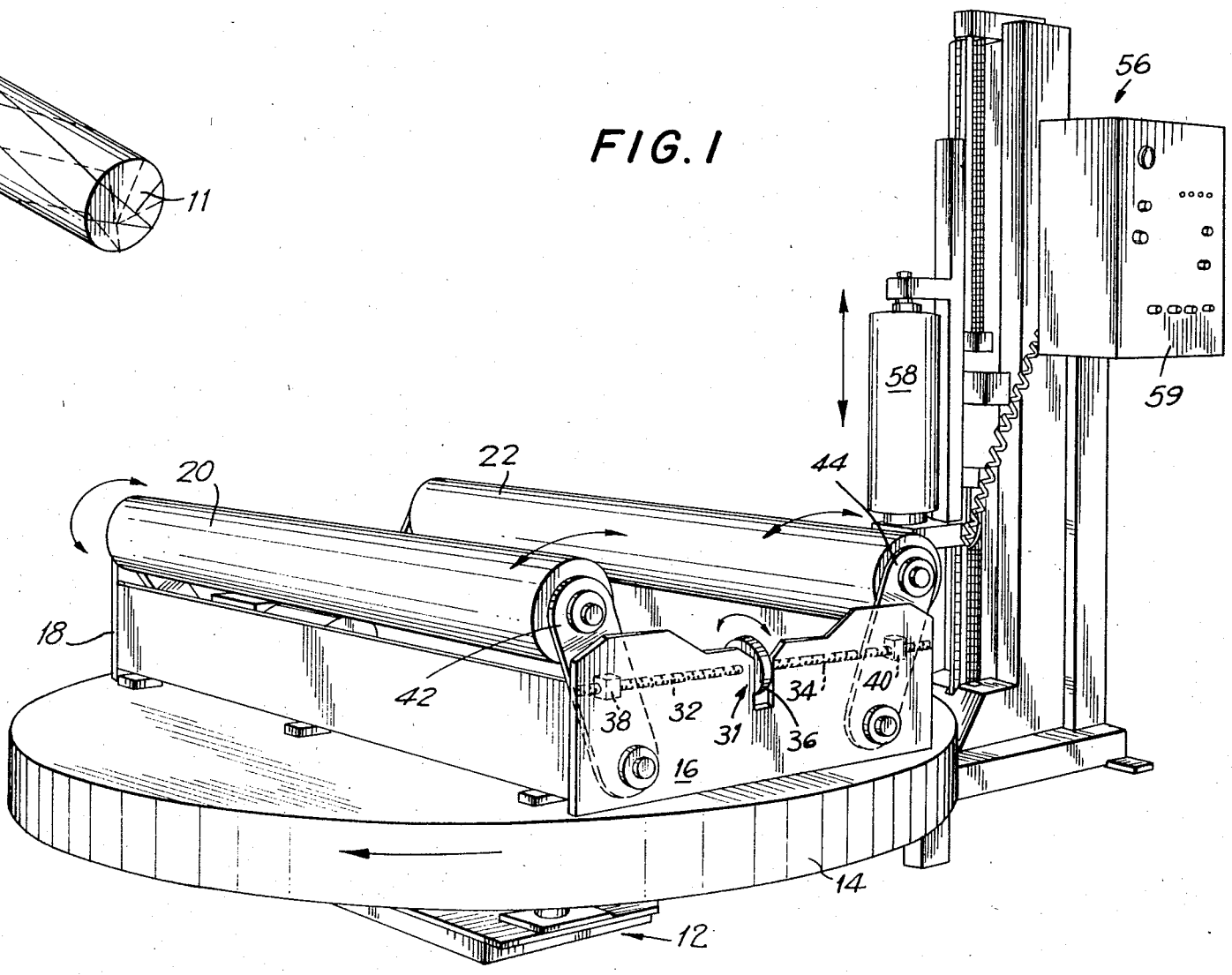
FIG. 1 is a perspective view of the roll wrapping apparatus of the present invention.
Figure 3:
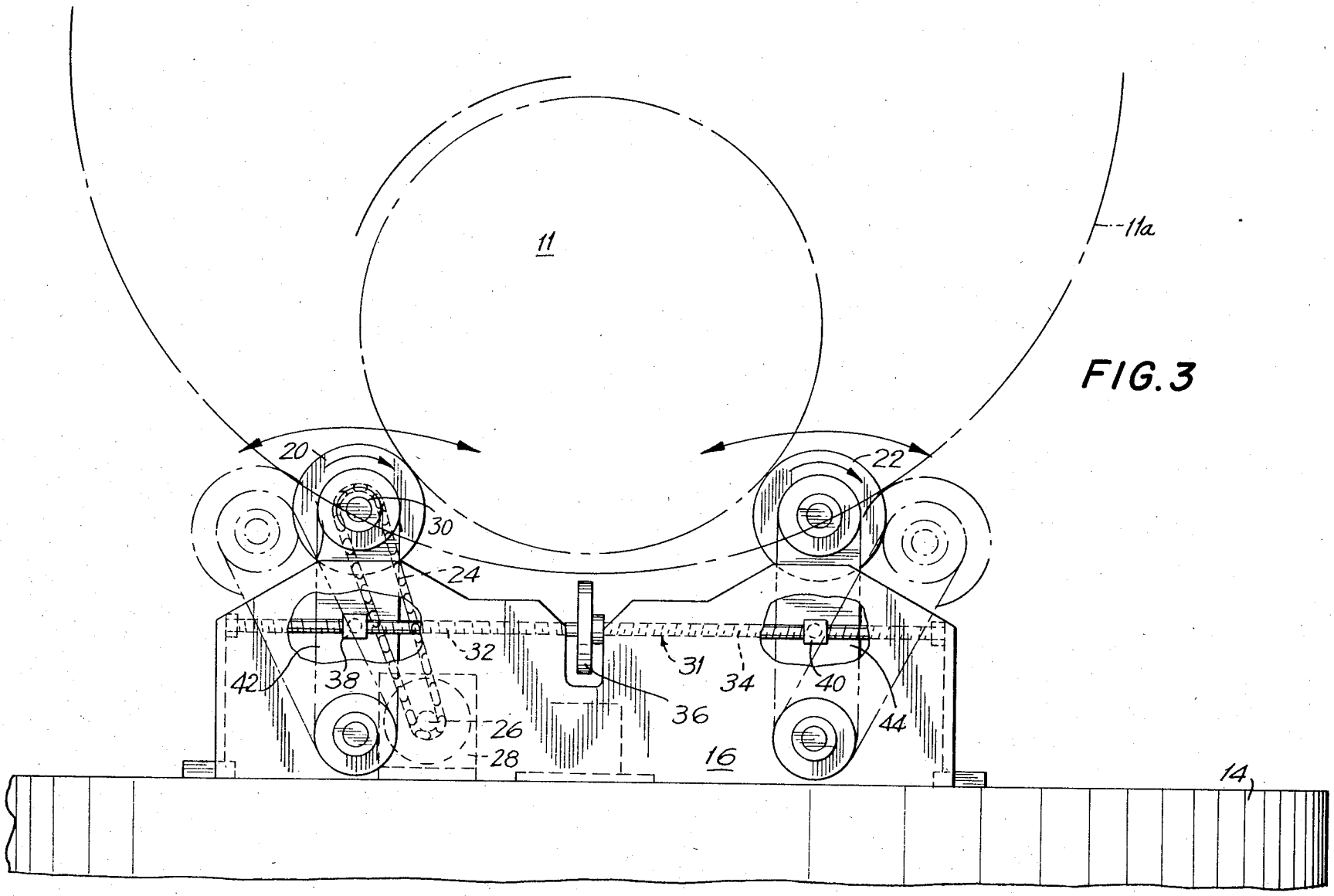
FIG. 3 is a side elevational view taken along lines 3—3 of FIG. 2.

Referring to FIG. 1 there is illustrated a roll wrapping apparatus 10 constructed according to the invention. The apparatus includes frame 12 having a platform 14 mounted for rotation thereon about a vertical axis extending substantially through its center. The platform 14 has fixed thereon vertical plates 16 and 18 which support elongated article support rollers 20 and 22 on which an article to be wrapped is positioned for wrapping. Of these support rollers, roller 20 is rotatably driven by roller chain 24 as shown in FIG. 3 which is in turn driven by pulley 26 attached to reversible motor 28 as also shown in FIG. 3. Thus, it will become clear that rotation of reversible motor 28 in either of its directions will in turn rotate sprocket 26 in the same direction and will correspondingly rotate roller drive chain 24 and sprocket 30 and consequently, article support roller 20 in the same direction. Thus, an article 11 positioned on rollers 20 and 22, when rotated, will cause rotation of roller 22 in a direction opposite the direction of roller 20 and reversal of the direction of roller 20 will cause a corresponding reversal of roller 22 such that it will cause a reversal of roller 22 to the opposite direction.

Referring now to FIG. 1 and FIG. 3, rod 31 includes two sections, 32 and 34, each having opposite threads, i.e. right hand and left hand, respectively, and a hand operated control wheel 36 which may be used to rotate rod 31 in either of two rotational directions. One end of rod 31 is threadedly engaged with right hand threaded lug (or nut) 38 and the other end 34 is threadedly engaged with left hand threaded lug (or nut) 40. Threaded lug 38 is connected to roller support plate 42 and threaded lug 40 which supports roller 20 is connected to roller support plate 44 which supports roller 22. Thus, manual rotation of hand wheel 36 in one direction will cause the rollers 20 and 22 to move toward each other, and rotation of hand wheel 36 in the other direction will cause the rollers 20 and 22 to move in directions opposite each other. The movement of the rollers by such rotation is equal and opposite and thus maintains the upward support forces provided by the rollers equidistant from the center of the rotating platform, thus preventing the weight of the article from shifting and thereby tilting the apparatus as in prior art devices which merely moved one roller to change the article size capability of the apparatus.

Figure 5:
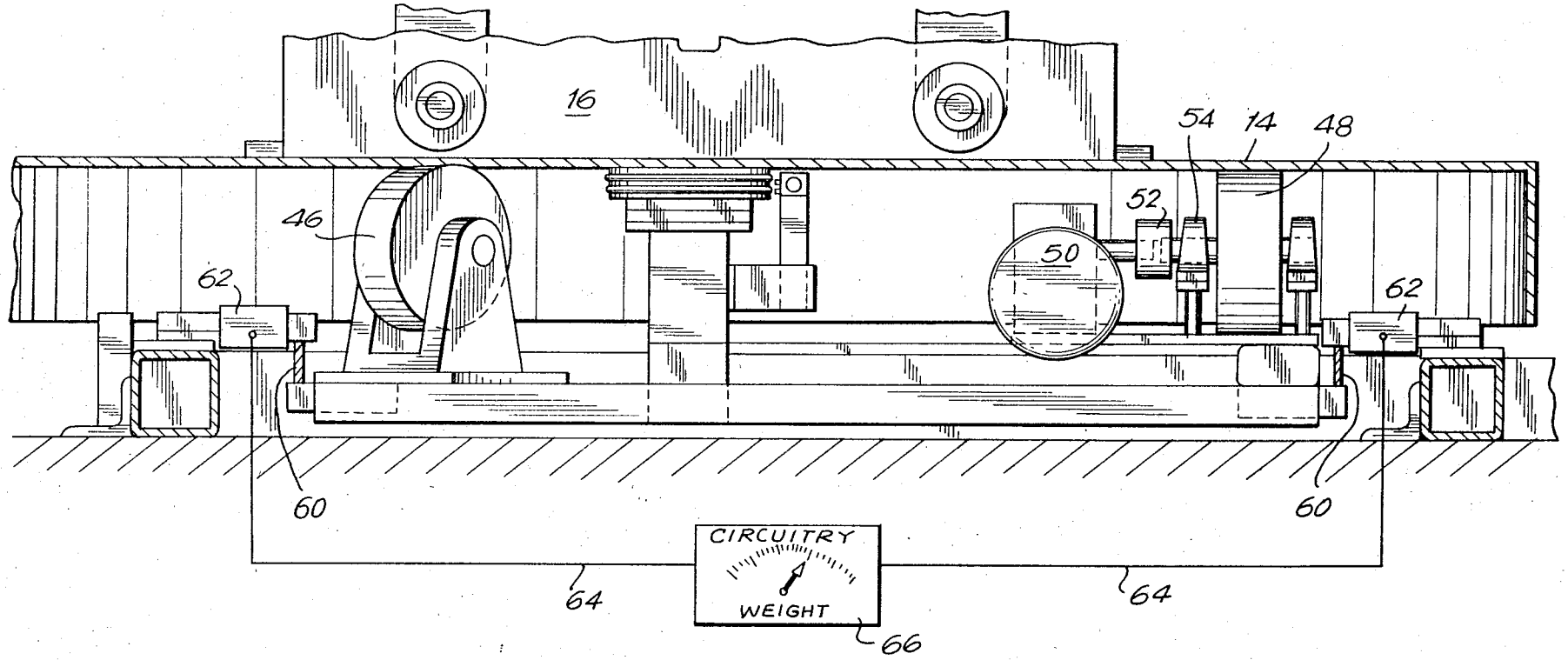
FIG. 5 is a view, partially in cross-section, taken along lines 5—5 of FIG. 4.

Referring now to FIG. 5 there is illustrated a partial cross-sectional view of the apparatus of FIG. 1 and FIG. 3 taken along lines 5—5 of FIG. 3. Rotational platform 14, on which article support rollers 20 and 22 are supported, is supported on a plurality, preferable three, support rollers, two of which are shown at 46 and 48. Roller 48 is driven via motor 50, coupling 52 and gearbox 54. At least roller 48 has a frictional surface which rotatably engages the under surface of platform 14 to thereby rotate it so as to in turn rotate the support rollers 20 and 22 as well as the article to be wrapped, about a vertical axis during the wrapping operation.

Referring once again to FIG. 1 there is shown a section 56 of the apparatus which supports and dispenses the web-type wrapping material. Any web-type wrapping material may be utilized, but preferably film materials as nylon, polypropylene, PVC, polybutylene, polyethylene, or other copolymers or blends thereof are preferred for their superior stretch wrapping capability. As noted previously, other materials known in the art may be used, and these materials would include netting, cloth, paper, etc. In addition, wrapping section 56 may include a roll 58 of such wrapping or netting material, rotatably mounted as shown, for dispensing as required by the rotating article, or it may include a system to pre-stretch the wrapping material such as the system marketed by MIMA INCORPORATED, under the trademark ACCU-STRETCH brand pre-stretch system.

Section 56 also includes control center 58 which displays a control panel having various control buttons or the like as shown, to control the rotation and directions of the various critical components of the apparatus for wrapping articles.

In operation, an article to be wrapped, such as is shown at 11 in FIG. 3, may be a cylindrically configured article such as a roll of carpet, a plurality of tires in face to face relation to form a cylindvical unit, or other such articles, and this article is placed upon the support rollers 20 and 22. If the article is small as shown, the hand wheel 36 is rotated to position support rollers 20 and 22 as shown in FIG. 3. If the article is larger, the handwheel 36 is correspondingly rotated to a position which accomodates large articles as shown by the phantom lines at 11*a* in FIG. 3. It is significant to note that for any article size, the center of gravity of the article remains fixed with respect to the support rollers 20 and 22 as well as rotating platform 14 and thus never shifts to either side of the rotating platform.

Once article 11 is positioned for wrapping, the platform 14 is rotated by actuating the appropriate controls which control platform drive motor 50 thereby causing the article to be rotated therewith about a vertical axis. In addition, an appropriate control which causes rotation of roller drive motor 28, roller chain 24 and support roller 20, which in turn rotates article 11 causing support roller 22 to also rotate in the same direction as support roller 20. The article thus rotates about a horizontal axis extending centrally thereof which axis is also rotating about the same central vertical axis about which platform 14 is rotating.

Figure 4:
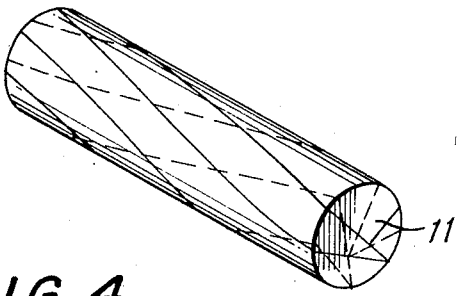
FIG. 4 is a perspective view in reduced size, of an elongated article completely wrapped by a web-type wrapping material on the apparatus of the invention.
Figure 2:
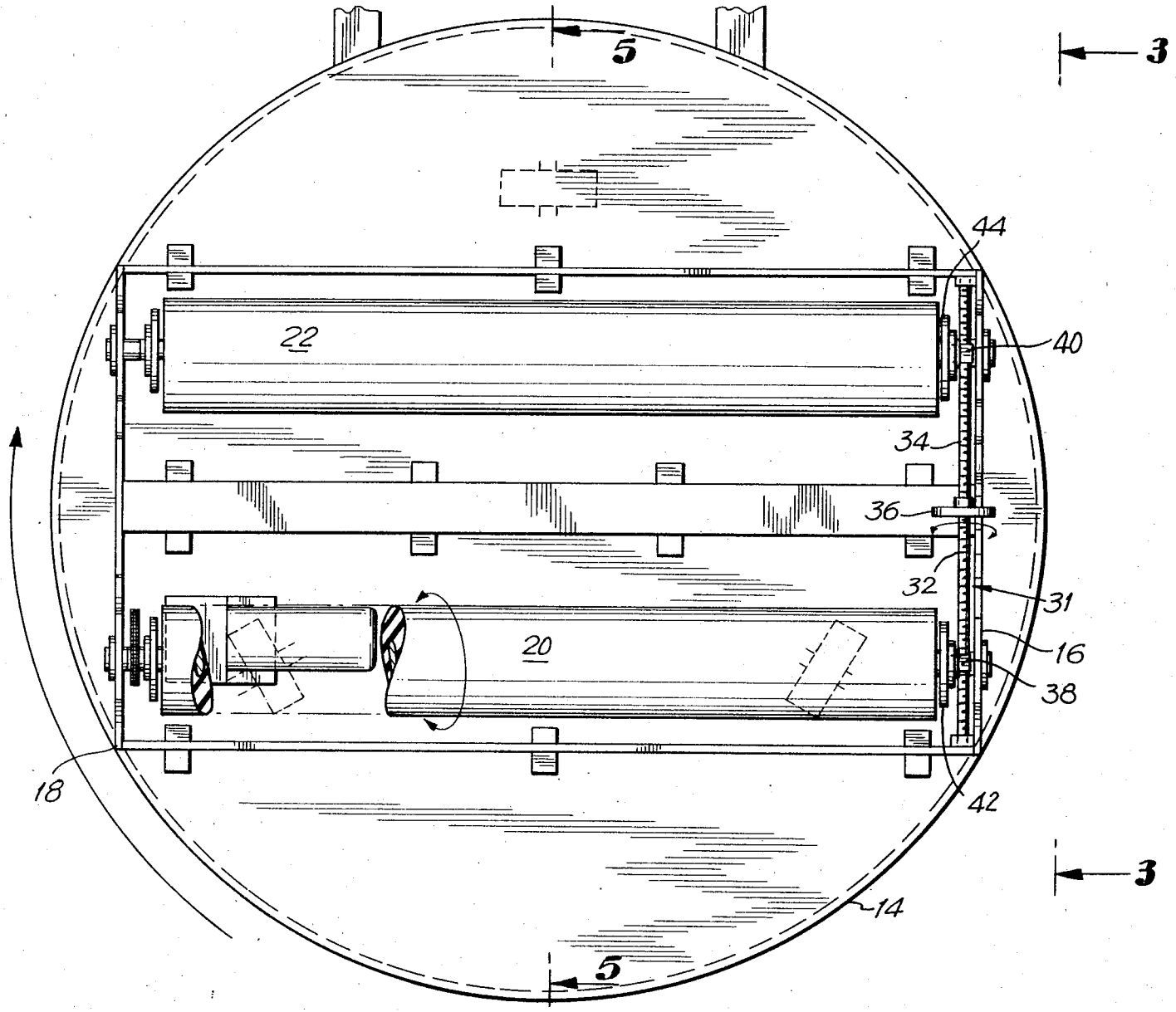
FIG. 2 is a top plan view of the apparatus of FIG. 1.

While the article is thus rotating about two axes, web-type wrapping material is dispensed from the wrapping section 56 either in stretched or non-stretchable condition as may be desired, so as to be wrapped about the article. As may be desired for a particular article, the direction of rotation of the roller 20 may be selectively reversed, thereby reversing the rotational direction of the workpiece as well as roller 22, thus causing the plastic wrapping material to assume a crisscross pattern about the article as shown in FIG. 4, with the web-type wrapping material in overlapped condition. The extent of overlap of the wrapping material is controlled by the rotational directions selected and the relative rotational speeds which are controlled through control panel 59.

Referring now to FIG. 5 there is illustrated a unique feature of the present invention which facilitates automatic weighing of the article, thus eliminating a separate step in the wrapping and weighing process. Rotational platform 14 is suspended from frame 12 by suitable cables 60, which are in turn connected to corresponding load cells 62. Two or more cables and corresponding electrical load cells are used, however, at least three or more cables and load cells are preferred.

Appropriate electrical circuitry 64 communicates with a suitable electrical bridge (i.e. Wheatstone type), which in turn provides a signal which is proportional to the weight on the load cells. Thus, before the article is positioned on the apparatus the initial weight of the rotatable platform 14 is removed from the weight reading (i.e. denoted as "tare") leaving a reading of zero weight on the dial 66. When the article is positioned for wrapping and later, is fully wrapped, the final weight of the wrapped article is provided on the scale, thus facilitating wrapping and weighing in a single operation. As noted previously, in the prior art, such steps were performed separately.

It will be appreciated that my invention facilitates an improved wrapping and weighing apparatus and method which not only provides improved wrapping, but which eliminates time consuming weighing operations which previously delaye delivery of articles by manufacturers and packagers.

We claim:

1. An apparatus for wrapping articles which comprises:

(a) a frame;

(b) a platform rotatably mounted on said frame and means for rotating said platform about a substantially vertical axis;

(c) at least two elongated support rollers mounted in spaced relation on said rotatable platform for rotation about substantially horizontal axes extending therethrough;

(d) a supply of web-type wrapping material mounted on said frame, said wrapping material supply being positioned and adapted for dispensing and wrapping about an article supported on said horizontally rotatable rollers as said platform rotates about a vertical axis;

(e) means for selectively moving said supply of wrapping material in an upward and downward direction so as to selectively vary the vertical height at which said wrapping material is dispensed from said wrapping material supply;

(f) means for rotatably driving at least one of said substantially horizontal rollers in either of two directions of rotation such that an article to be wrapped rotates about a substantially horizontal axis when said driven support roller is rotated in a first direction and said rotating article engages said other horizontal support roller and thereby rotates said other support roller in the same direction as said first driven roller;

(g) means for selectively varying the spacing between said horizontal rotatable support rollers by substantially equal and opposite movements respectively toward or away from each other to maintain said article in substantially the same location with respect to said frame and thereby providing capability to support articles of numerous sizes and weights; and (h) weighing means positioned between said rotatable platform and said frame for generating a signal which corresponds to the weight of an article positioned on said frame so as to thereby provide the weight of the article while said article is on said support rollers.

2. The apparatus of claim 1 wherein said means for selectively varying the spacing between said support rollers is a rod member having two equal sections with opposite threads; each section of said rod member being threadedly engaged with means connected to a roller support plate.

3. The apparatus according to claim 2 wherein said means for providing said weight indication is a plurality of load cells connected to said apparatus and to an electrical circuit.

4. The apparatus according to claim 3 wherein said plurality of load cells are equally distributed with respect to said rotatable platform.

5. The apparatus according to claim 4 wherein said load cells and said electrical circuitry comprises means for indicating the weight of said rotatable platform and the article positioned thereon.

6. The apparatus according to claim 5 wherein said load cells and said electrical circuitry comprises means for initially substracting the weight of said platform and related components from said indicated weight thereby indicating the weight of said article.

7. The apparatus according to claim 6 wherein at least one of said horizontally rotatable rollers is driven by a motor.

8. The apparatus according to claim 7 wherein said motor is connected for driving rotation of said first mentioned support roller by a system of sprockets or pulleys and at least one roller chain or pulley belt.

9. The apparatus according to claim 8 wherein the direction of said roller drive motor is selectively reversible so as to facilitate reversing the direction of said first mentioned driven horizontal support roller and thereby correspondingly simultaneously reversing the direction of rotation of said article as said platform is rotated about a substantially vertical direction.

10. The apparatus according to claim 9 wherein said means for varying the dimension between said horizontally rotatable support rollers comprises an elongated threaded rod threadedly connected to opposite support roller support members, each roller support member respectively supporting one of said horizontally rotatable rollers for rotation about a horizontal axis extending therethrough.

11. The apparatus according to claim 10 wherein said threaded rod is comprised of two sections having a manually operable adjustment means connected thereto.

12. The apparatus according to claim 11 wherein said two sections of said threaded rod are equally and oppositely threaded.

13. The apparatus according to claim 12 wherein said respective two sections of said threaded rod are connected to correspondingly mating threaded members respectively connected to the respective support members of said horizontally rotatable support rollers.

14. The apparatus according to claim 13 wherein said manual adjustment means comprises a hand operable wheel connected to said rod at its center, such that rotation of said wheel rotates said threaded rod thereby causing said roller support members and said rollers to be moved toward or away from each other in equal and opposite directions in dependence upon the direction of rotation selected for said adjustment wheel for varying the dimension between said horizontal support rollers in dependence upon the dimensions of the article to be wrapped, such that the rotation of said horizontal platform about a vertical axis combined with the rotation of said horizontal support rollers and said article about a horizontal axis and the selective upward and downward movement of said supply of stretchable netting material as said netting material is dispensed and wrapped about said rotating article combined with selective reversible rotation of said driven horizonal roller causing said article to selectively reverse its direction of rotation about a horizontal axis thereby providing a criss-cross wrapping pattern of said netting material about said article.

15. The apparatus according to claim 14 wherein said web-type wrapping material is paper or cloth.

16. The apparatus according to claim 14 wherein said web-type wrapping material is stretchable thermoplastic film or netting.

17. The apparatus according to claim 16 wherein said stretchable thermoplastic film or netting is nylon, polypropylene, PVC, polybutylene, polyethylene, or copolymers or blends thereof.

18. The apparatus according to claim 15 further comprising means to support and dispense web-type wrapping material in a non-stretched condition.

19. The apparatus according to claim 16 further comprising means to support and dispense web-type wrapping material in a non-stretched condition.

20. The apparatus according to claim 16 further comprising means to support and dispense the stretchable thermoplastic film or netting in a pre-stretched condition.

21. A method for roll wrapping articles or the like which comprises:

(a) supporting an article on at least two support rollers, at least one of said support rollers being rotatably driven, the other support roller being supported for rotation about a horizontal axis;

(b) selectively varying the spacing between said support rollers by substantially equal and opposite movements respectively toward or away from each other to support said article while maintaining said article in substantially the same location with respect to said support rollers;

(c) supporting said support rollers on a rotatable platform means, selectively driven by motor and drive means connected thereto;

(d) providing a supply of web-type wrapping material positioned for dispensing and wrapping about the article;

(e) rotating said platform means and said article support rollers and the article about a substantially vertical axis;

(f) selectively rotating said driven support roller so as to rotate the article about a substantially horizontal axis, and said other support roller therewith;

(g) selectively moving said supply of wrapping material in upward or downward directions so as to selectively vary the vertical height at which said wrapping material is dispensed from said wrapping material supply;

(h) selectively reversing the rotational direction of said driven article support roller as said article rotates about the substantially vertical axis, and as said web-type wrapping material is wrapped thereabout so as to provide a criss-cross wrapped pattern of wrapping material about said article; and (i) simultaneously weighing said article while said article is on said support rollers by weighing means comprising load cells and circuitry located on, and connected to, said platform means to facilitate wrapping and weighing in a single operation.

22. The method of claim 21 wherein the spacing between the support rollers is varied by automatically or manually rotating in a predetermined direction a rod member having two substantially equal sections each having relatively opposite threads; each section of said rod member being threadedly engaged with means connected to a roller support plate to cause said support rollers to move toward or away from each other.

23. The method according to claim 22 wherein said web-type wrapping material is nylon, polypropylene, PVC, polybutylene, polyethylene, or copolymers or blends thereof, or cloth.

24. The method according to claim 22 wherein said web-type wrapping material is paper or cardboard.

* * * * *